US007290496B2

(12) United States Patent
Asfar et al.

(10) Patent No.: US 7,290,496 B2
(45) Date of Patent: Nov. 6, 2007

(54) UNMANNED AUTONOMOUS SUBMARINE

(76) Inventors: Khaled R. Asfar, Dept. of Mechanical Engineering, Jordan University of Science & Technology, P.O. Box 3030, Irbid 22110 (JO); Khalid A. Rashdan, P.O. Box 851295, Amman 11185 (JO); Yasser J. Al-Alami, P.O. Box 9899, Amman 11191 (JO)

( * ) Notice: Subject to any disclaimer, the term of this patent is extended or adjusted under 35 U.S.C. 154(b) by 0 days.

(21) Appl. No.: 11/580,809

(22) Filed: Oct. 12, 2006

(65) Prior Publication Data

US 2007/0125289 A1 Jun. 7, 2007

Related U.S. Application Data

(60) Provisional application No. 60/726,498, filed on Oct. 12, 2005, provisional application No. 60/778,004, filed on Feb. 28, 2006.

(51) Int. Cl.
*B63G 8/22* (2006.01)

(52) U.S. Cl. ..... 114/312; 114/333

(58) Field of Classification Search ..... 114/125, 114/312, 333

See application file for complete search history.

(56) References Cited

U.S. PATENT DOCUMENTS

| | | | |
|---|---|---|---|
| 340,237 | A | 4/1886 | Nagel et al. |
| 1,310,877 | A | 7/1919 | Schneider |
| 1,488,067 | A | 3/1924 | Schneider |
| 1,571,833 | A | 2/1926 | DeFeo |
| 3,122,121 | A | 2/1964 | Krauth |
| 3,176,648 | A | 4/1965 | Cavero |
| 3,301,132 | A | 1/1967 | Lehman et al. |
| 3,379,156 | A | 4/1968 | Keays et al. |
| 3,474,750 | A | 10/1969 | LeBleu |
| 3,478,711 | A | 11/1969 | Combs |
| 3,492,965 | A | 2/1970 | Wayfield |
| 3,550,386 | A | 12/1970 | Ballinger |
| 3,561,387 | A | 2/1971 | Kumm et al. |
| 3,667,415 | A | 6/1972 | Robbins, Jr. |
| 3,800,722 | A | 4/1974 | Lepage |
| 3,818,523 | A | 6/1974 | Stillman |
| 3,943,869 | A | 3/1976 | Frechette |
| 3,946,685 | A | 3/1976 | Chadbourne et al. |
| 4,029,034 | A | 6/1977 | Mason |
| 4,266,500 | A | 5/1981 | Jurca |

(Continued)

FOREIGN PATENT DOCUMENTS

JP 356071694 A 6/1981

*Primary Examiner*—Stephen Avila
(74) *Attorney, Agent, or Firm*—Abelman, Frayne & Schwab

(57) ABSTRACT

An unmanned autonomous submarine which can float, dive and move in water to perform various tasks. The submarine includes a pressurized cabin which is necessary for the diving and flotation system to work properly. This also helps to increase its sealing power against water leakage into the cabin. The submarine is autonomous, that is automatic and self controlled. It is propelled by water jet propulsion. It can be programmed to dive to preset depths, move along preset trajectories, and return to the base after completing the assigned tasks. A remote control option is provided in order to perform special tasks. The submarine is equipped with several sensors that can measure depth, orientation, attitude, location and speed. It is also equipped with an underwater video camera that can send wireless video pictures from underwater to a monitor above water surface.

39 Claims, 11 Drawing Sheets

U.S. PATENT DOCUMENTS

| | | | | |
|---|---|---|---|---|
| 4,448,145 | A | 5/1984 | Hervieu | |
| 5,129,348 | A * | 7/1992 | Rannenberg et al. | 114/333 |
| 5,235,930 | A * | 8/1993 | Pendleton | 114/312 |
| 5,579,285 | A | 11/1996 | Hubert | |
| 5,613,460 | A * | 3/1997 | Stallard, III | 114/312 |
| 5,637,825 | A * | 6/1997 | Glenning | 114/21.1 |
| 5,686,694 | A | 11/1997 | Hillenbrand et al. | |
| 5,711,244 | A * | 1/1998 | Knapp | 114/312 |
| 6,065,418 | A | 5/2000 | Goldstein et al. | |
| 6,269,763 | B1 * | 8/2001 | Woodland | 114/382 |
| 6,371,041 | B1 * | 4/2002 | Ness | 114/333 |
| 6,453,835 | B2 | 9/2002 | Fadeley et al. | |
| 6,484,660 | B1 * | 11/2002 | English | 114/312 |
| 6,581,537 | B2 | 6/2003 | McBride et al. | |
| 6,629,866 | B2 | 10/2003 | Burg | |
| 6,655,313 | B1 | 12/2003 | Woodall et al. | |
| 6,662,742 | B2 | 12/2003 | Shelton et al. | |
| 6,716,075 | B2 | 4/2004 | Fuse et al. | |
| 6,772,705 | B2 | 8/2004 | Leonard et al. | |
| 6,800,003 | B2 | 10/2004 | Hill et al. | |
| 6,807,921 | B2 | 10/2004 | Huntsman | |
| 6,926,567 | B1 | 8/2005 | Dai et al. | |
| 2001/0010987 | A1 | 8/2001 | Fadeley et al. | |
| 2001/0025594 | A1 * | 10/2001 | Daniels | 114/315 |
| 2002/0134294 | A1 | 9/2002 | Woodall et al. | |

* cited by examiner

UNMANNED AUTONOMOUS SUBMARINE

CROSS-REFERENCES TO RELATED APPLICATIONS

This application claims the benefit of U.S. Provisional Application Ser. No. 60/726,498, filed Oct. 12, 2005, and U.S. Provisional Application Ser. No. 60/778,004, filed Feb. 28, 2006, the contents of which are incorporated by reference herein and made a part of this application.

FIELD OF THE INVENTION

The present invention relates generally to submersible vehicles, and particularly to unmanned autonomous submarines, and sometimes referred to as "small" submarines.

BACKGROUND OF THE INVENTION

There have been numerous unmanned submarines designed to explore or perform other underwater tasks and functions, as required. The submersible vehicle (i.e., a submarine) includes various systems, such as a ballast system for submersing or floating the submarine, a propulsion system for propelling the submarine, a navigation or steering system for maneuvering the submarine, and various sensors and controllers for controlling the submarine and providing information regarding the underwater environment.

For example, U.S. Pat. Nos. 1,571,833, 5,235,930, 5,711,244, and 6,655,313 disclose a submarine body from separate sections that are joined together and include seals. U.S. Pat. Nos. 1,310,877, 1,488,067, 3,379,156, 3,478,711, 3,667,415, 3,800,722, 3,818,523, 3,943,869, 3,946,685, 4,029,034, 4,265,500, 5,129,348, 6,371,041 and 6,772,705 disclose ballast means combining water and air through a system of valves and piping for controlling the depth direction of a submarine. U.S. Pat. Nos. 3,122,121, 3,176,648, 3,474,750, 3,492,965, 3,550,386, 6,065,418, 6,807,921 and 6,581,537 disclose fluid propulsion of a vessel through the handling of the fluid from the bow to the stem of the vessel. U.S. Pat. Nos. 3,561,387, 6,269,763, 6,484,660, 6,662,742 and U.S. Publication No. 2002/0134294 disclose use of a plurality of sensors and structural concepts and relate generally to the state of the art. U.S. Pat. Nos. 6,926,567, 6,800,003, 6,716,075, 6,629,866, 6,453,835, 3,301,132, 340,237, U.S. Patent Publication No. 2001/0010987 and Japanese Pat. Application No. 356071694 relate to fluid deflection.

None of the known patents or publications disclose or suggest an unmanned autonomous submarine as disclosed and claimed herein.

SUMMARY OF THE INVENTION

In general, it is an object of the present invention to provide an unmanned autonomous small size submarine as described herein. This submarine is a surface/underwater vehicle which can float, dive and move in water to perform various tasks. One important feature of the submarine is the pressurized cabin which is necessary for the diving and flotation system to work properly. This also helps to increase its sealing power against water leakage into the cabin. The submarine is autonomous, that is, automatic and self controlled. It is propelled by water jet propulsion. It can be programmed to dive to preset depths, move along preset trajectories, and return to the base after completing the assigned tasks. In addition to the autonomous part, a remote control option is provided for emergency situations or in order to perform special tasks. The submarine is equipped with several sensors that can measure depth, orientation, attitude, location and speed. It is also equipped with an underwater video camera that can send wireless video pictures from underwater to a monitor above water surface.

Various objectives of the unmanned autonomous submarine are to perform several tasks above and under water replacing human divers who can be subjected to danger in such environment; minimize the cost of underwater operations such as exploration, rescue, photography, and inspection of submerged structures, such as ship hulls, oil rigs, dams, etc.; monitor various objects under water and transmit live video and pictures to the operator on board of a commanding boat above water; be used as a carrier and base for underwater robotics, among other undersea functions and tasks.

In one embodiment, the unmanned autonomous submarine comprises a hull formed by at least two hull sections and defining an interior cabin therein and adapted to retain pressurized air. A plurality of fasteners are affixed to the hull sections and adapted for joining the at least two hull sections. The plurality of fasteners can e internally and/or externally affixed to opposing connecting ends of the hull sections.

A plurality of hydrofoils is attached to opposed external side surfaces of the hull sections for providing stability and maneuverability of the hull. The submarine further includes a propulsion system for providing propelling force to the hull.

A ballast system is included for raising and submersing the hull. The ballast system comprises a ballast tank adapted to receive a predetermined level of water externally from the submarine and a predetermined amount of the pressurized air from the cabin; and a compressor coupled to the ballast tank to form a closed loop system. The compressor is adapted to force air into the cabin from the ballast tank to increase the water level in the tank and thereby cause the hull to submerge, and the compressor being adapted to force air into the ballast tank from the cabin to decrease the water level in the tank and thereby cause the submarine to ascend.

In one embodiment, the submarine includes a sealable opening formed in the upper portion of one of the hull sections. The sealable opening provides access into the interior cabin.

In one embodiment, the plurality of fasteners includes a plurality of clamps. Alternatively, the plurality of fasteners can include a plurality of bolts positioned on one of the connecting ends of a hull section and threaded into a corresponding plurality of nuts affixed to an opposing connecting end of an adjacent hull section.

In one embodiment, the submarine further comprises an o-ring inserted between each adjacent hull section. In an alternative embodiment, the submarine includes a reinforcing ring inserted between each adjacent hull section, either with or without the o-ring.

In one embodiment, the ballast tank comprises a plurality of partitions to prevent water in the tank from destabilizing the submarine. Further, the ballast tank can include a sealable opening formed at its bottom for controlling flow of water in or out of the tank. Additionally, the ballast system can include at least one solenoid valve for controlling air flow between the cabin and the ballast tank.

In one embodiment, the propulsion system includes a first water pump positioned in the cabin, a forward inlet port formed in a forward hull section of the hull sections and coupled to the pump via a first conduit, and an aft outlet port formed in an aft hull section of the hull sections and coupled to an output of the first pump via an aft conduit. The first pump draws water external to the hull through the forward inlet port and first conduit, and forces the water through the aft outlet port to propel the submarine in a forward direction. Alternatively, the first water pump draws water external of the hull through the aft outlet port and the aft conduit, and forces the water through the forward inlet port to propel the submarine in a reverse direction.

The propulsion system can further include a second aft outlet port formed in the aft hull section and coupled to the first pump via a second aft conduit. The aft conduits are regulated to control water flow therethrough to provide steering of the submarine.

In another embodiment of the propulsion system, a second water pump is serially coupled to the first water pump. The second water pump is deactivated while the first pump is activated to propel the submarine in the forward direction. Similarly, the first pump is deactivated while the second pump is activated to draw water external to the hull through the aft outlet port and aft conduit, and force the water out of the forward inlet port to propel the submarine in a reverse direction.

In yet another embodiment of the submarine, a plate is pivotably attached in a vertical direction in the aft outlet port. The vertically positioned plate is rotatable to direct the water jetted out of the aft outlet port at a predetermined angle to steer the submarine. Preferably, a vertical rudder rotatable attached to the aft hull section, and a link coupled between the rudder and vertical plate. Rotation of the plate is controlled by rotation of the rudder.

In yet another embodiment of the propulsion system, the propulsion system includes a forward water pump positioned in the cabin, a forward inlet port formed in a forward hull section of the hull sections and coupled to the forward pump via a forward conduit, and a pair of parallel water pumps positioned in the cabin. The parallel pumps are coupled to the forward water pump via a Y-shaped conduit. A pair of aft outlet ports is formed in an aft hull section of the hull sections. Each aft outlet port is coupled to a corresponding one of the parallel water pumps via a second conduit.

At least one of the parallel water pumps draws water external to the hull through the forward inlet port and forward conduit, and forces the water out of the corresponding aft outlet port to propel the submarine in a substantially forward direction. Preferably, the forward water pump is deactivated when the pair of parallel water pumps is activated to propel the submarine in a substantially forward direction. Alternatively, the pair of parallel pumps can be deactivated while the forward pump is activated to draw water external to the hull through the aft outlet ports and Y-shaped conduit, and force the water out of the forward inlet port to propel the submarine in a reverse direction.

In another embodiment, the pumps can be utilized to steer the submarine. In particular one of the parallel pumps is either throttled back or deactivated while the other parallel pump is activated to steer the submarine in a predetermined direction.

In one embodiment, the submarine further includes a vertical rudder rotatably attached to the aft hull section of the hull sections for steering the submarine. Further, the plurality of hydrofoils can include a pair of aft hydrofoils rotatably attached to opposing side surfaces of an aft hull section of the hull sections. The rotatably attached hydrofoils enable the submarine to submerge and ascend. Additionally, the plurality of hydrofoils can include a pair of forward hydrofoils fixedly attached to the opposing side surfaces proximate a forward hull section of the hull sections. The fixedly attached hydrofoils provide stability for the submarine. Alternatively, the pair of forward hydrofoils is rotatably attached to the opposing side surfaces proximate a forward hull section of the hull sections. The rotatably attached hydrofoils enable the submarine to submerge and ascend.

In one embodiment, the hull sections include a forward hull section, an aft hull section, and a middle hull section attached therebetween the forward and aft hull sections via the plurality of fasteners.

In yet another embodiment of the propulsion system, the propulsion system includes a pair of forward inlet ports formed in a forward hull section of the hull sections, and a pair of parallel water pumps positioned in the cabin. Each parallel pump is coupled to a corresponding one of the pair of forward inlet ports via a forward conduit. A pair of aft outlet ports is formed in an aft hull section of the hull sections, where each aft outlet port is coupled to a corresponding output of one of the parallel water pumps via an aft conduit. At least one of the parallel water pumps draws water external of the hull through the corresponding forward inlet port and forward conduit, and forces the water out of the corresponding aft outlet port to propel and steer the submarine in a substantially forward direction. Alternatively, at least one of the parallel water pumps draws water external to the hull through the corresponding aft outlet port and aft conduit, and forces the water out of the corresponding forward inlet port to propel and steer the submarine in a substantially reverse direction.

In any of the aforementioned embodiments, the submarine can further include a programmable controller for controlling operations of the submarine. Additionally, one or more sensors can be installed on the submarine for providing electrical signals to the controller for further controlling the submarine operations. The one or more sensors can include depth sensors, GPS system sensors, pressure sensors, position and orientation sensors, speed sensors, leakage sensors, audio sensors and video sensors, among other sensors. Further, at least one robotic arm can be mounted to the hull and electrically coupled to the controller.

In any of the aforementioned embodiments, the submarine can further include at least one battery for providing power to the submarine. In one embodiment, the at least one battery is rechargeable. Further, an array of photovoltaic cells can be mounted to the exterior surface of the hull. The array of photovoltaic cells can be used to provide charge to the rechargeable batteries or provide power to the one or more systems in the submarine.

In one embodiment, the submarine includes a receiver for receiving remote command signals to control operations of the submarine. Further, a transmitter can be provided for sending operational information to a remotely located receiver.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

Figure 1:
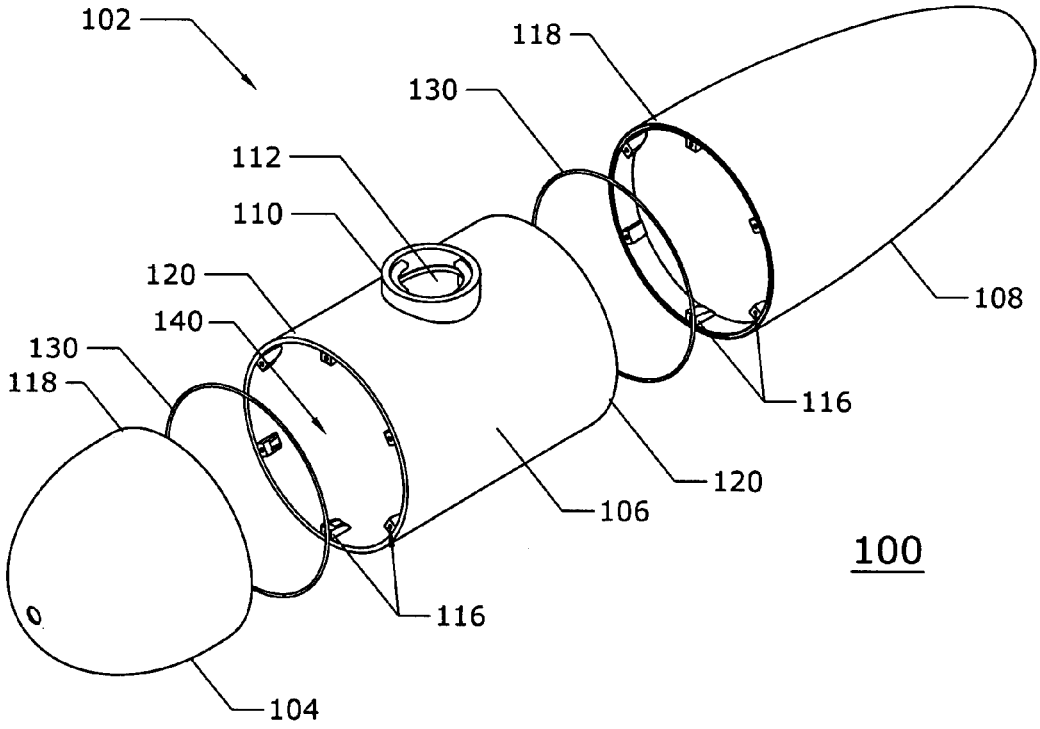
FIG. 1 is an enlarged front top perspective view of an embodiment of an unmanned autonomous submarine according to the present invention having a plurality of hull sections according to one embodiment of the invention.

To facilitate understanding of the invention, the same reference numerals have been used when appropriate, to designate the same or similar elements that are common to the figures. Further, unless stated otherwise, the drawings shown and discussed in the figures are not drawn to scale, but are shown for illustrative purposes only.

DETAILED DESCRIPTION OF THE PREFERRED EMBODIMENTS

Reference will now be made to the preferred embodiments of the invention, examples of which are illustrated in the accompanying drawings FIGS. 1-26. An exemplary embodiment of an unmanned autonomous submarine of the present invention is shown in FIG. 1, and is designated generally throughout by reference numeral 100.

Hull Configuration

Figure 2:
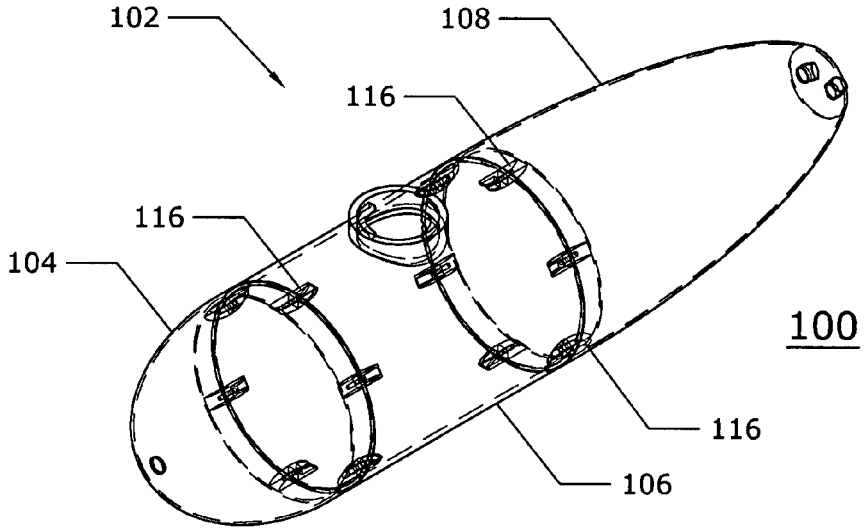
FIG. 2 is a front and top perspective view of the unmanned autonomous submarine of FIG. 1 having the hull sections assembled by a plurality of internal clasps.

Referring to FIGS. 1 and 2, there is depicted in an enlarged view, with components separated for convenience of illustration, of a submarine hull 102 having a forward hull section 104, a middle hull section 106, and an aft ward hull section 108. The preferred shape of the hull 102 is a slender axi-symmetric body of revolution, where the length is larger than the maximum diameter of the submarine. For example, in one embodiment, the hull 102 of the submarine is 1.645 m long, with a maximum outside diameter of 40 centimeters, although such dimensions are not considered limiting.

Several alternative configurations of the hull (body) 102 of the submarine 100 are possible within the scope of the invention. The submarine 100 can be assembled from two, three, or more hull sections with appropriate sealing devices 120. The most structurally efficient hull shape of the submarine is a circular cross-section. A hull 102 having a substantially circular cross-section is easy to fabricate and is streamlined for maximum drag reduction. The shape of the hull 102 is not limited to being circular, as other hull section shapes can be utilized to satisfy particular applications or purposes by the submarine 100.

In one embodiment as shown in FIGS. 1 and 2, the forward or nose section 104 is a hemisphere, and the aft or rear tail section 108 is a semi-ellipsoid of revolution. The hull sections 102 of the submarine can be fabricated by welding or otherwise fastening together sheet metal strips (e.g. 3 mm thick steel sheets). Alternatively, the hull sections can also be cast from any suitable material. For example, the hull sections 102 of the submarine can be made from steel, fiberglass, among other well known materials and/or a combination thereof which are capable of withstanding the water pressure when submersed at particular depths.

In the embodiment shown in FIGS. 1 and 2, an opening 110 is formed in the upper side of one of the body sections (preferably the middle hull section 106) with a removable cover 112. The opening 110 is provided for access to the cabin 140 during assembly and servicing of the submarine 100. The removable cover 112 is provided to seal and protect the interior of cabin 140 of the submarine 100 from the external water environment. Additionally, as discussed in further detail with respect to FIG. 2, the opening 110 facilitates assembly of the hull sections 108 using internal clamps 116. Further, although not shown in FIGS. 1-3, the hull 102 includes a number of fixed or rotatable lifting and steering surfaces preferably made from hydrofoils which provide stability and control (i.e., maneuverability) during operation of the submarine 100, as is discussed below in further detail with respect to FIGS. 13-19.

Figure 3:
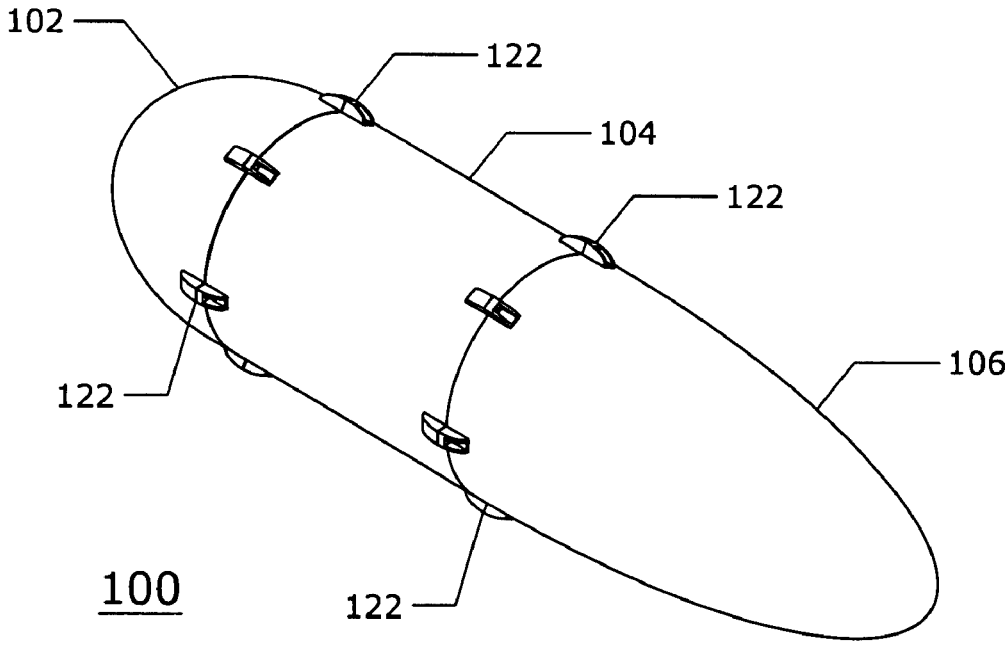
FIG. 3 is a front and top perspective view of the unmanned autonomous submarine of FIG. 1 having the hull sections assembled by a plurality of external clasps.

Referring to FIGS. 2 and 3, the hull sections 102 of the submarine 100 are shown assembled together and secured by internal or external clamps. Referring to FIG. 2, internal clamps 116 are preferably used, since they do not create any resistance to the submarine motion while submersed in the water and thus produce a smooth continuous surface. The open ends of the forward hull 104 and aft hull 108 sections include circular end ring portions 118 having a diameter substantially equal to the diameter of the middle hull section 106, to thereby provide a continuous smooth exterior surface where the hull sections are secured together. All three hull sections are joined together within the interior of the submarine by suitable fasteners 116, such as with spring clamps 116 for quick and easy assembly, or a number of bolt/nut combinations.

In an embodiment implementing a bolt/nut combination, a plurality of bolts are provided on one ring (e.g., on rings 120 formed on opposing ends of the middle hull section 106), and each bolt is inserted through thick washers welded to the same ring 120. The bolts are threaded into mating nuts welded to a second mating ring, for example, circular end rings 118 formed on the forward and aft hull sections. An O-ring 130 is located between each two mating parts of the hull sections 102 in order to provide sealing power against water leakage. The bolts and internal clamps 116 are accessed during assembly through the central body opening 110.

Referring to FIG. 3, in an alternative embodiment, the submarine body 102 is assembled by using external clamps 122. The external clamps 122 are provide easy assembly of the hull sections 102.

Figure 4:
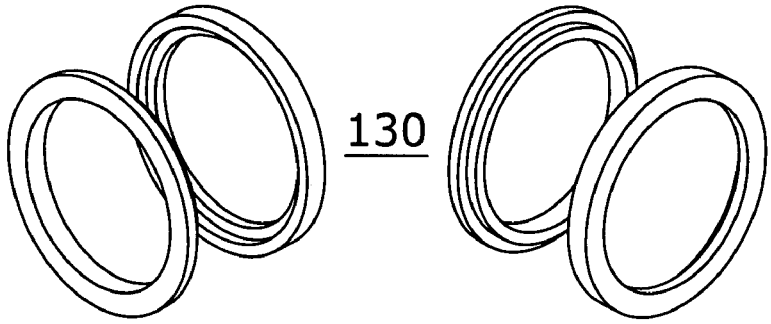
FIG. 4 is a side perspective view of a plurality of reinforcing rings for coupling the hull sections of FIG. 1.
Figure 5:
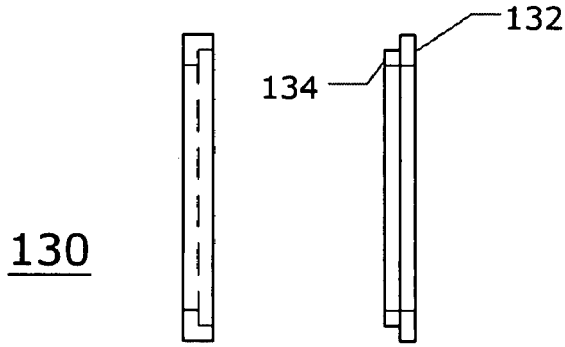
FIG. 5 is schematic diagram of the reinforcing rings of FIG. 4.

Referring to FIGS. 4 and 5, the three hull sections 104, 106 and 108 are joined together and assembled using O-rings 130, such as rubber O-rings 132 for providing a watertight seal between the joined hull sections lO2. The O-rings 130 can optionally include steel reinforcement rings 134 to form a combined steel and rubber reinforcing/coupling O-ring. The steel/rubber O-rings serve as couplers between the hull sections, as well as stiffeners because they increase the rigidity and integrity of the body of the submarine against wrinkling and deformation.

Figure 6:
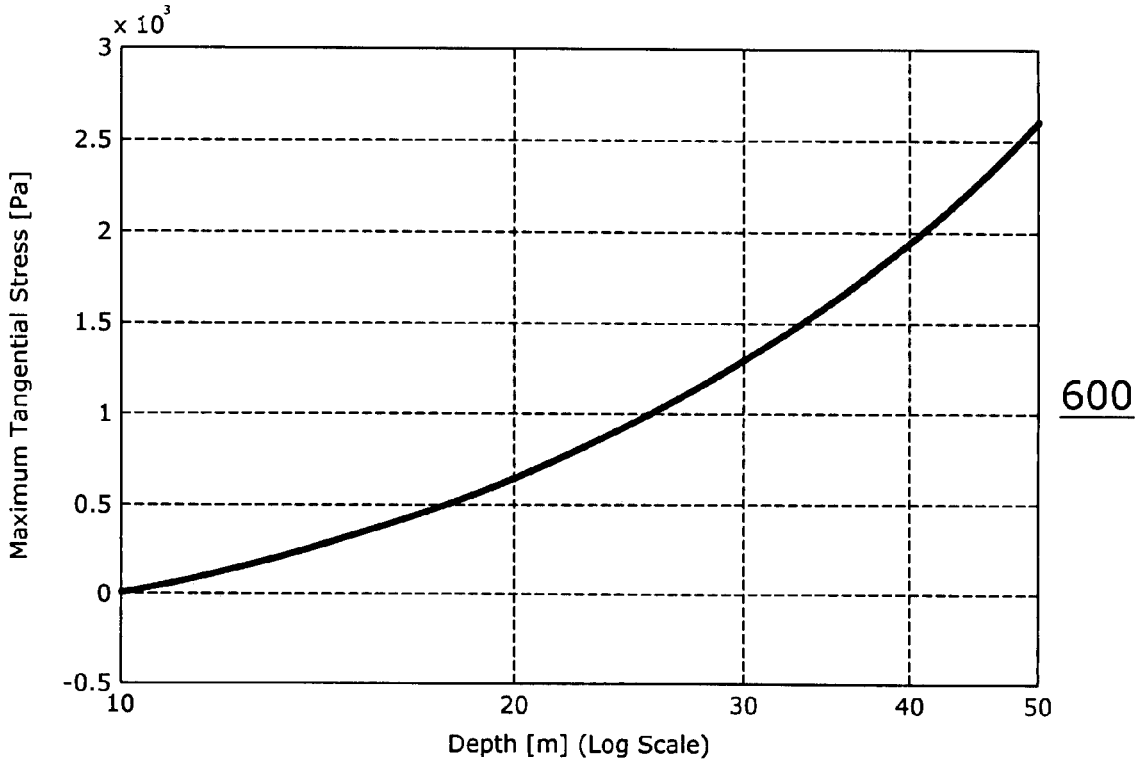
FIG. 6 is a graphical view illustrating the depth and maximum tangential component of stress affecting the submarine of FIG. 1.

Referring to the graph 600 of FIG. 6, the relationship between the outside pressure at a certain depth and the maximum tangential component of stress affecting the inner radius of the cylindrical middle hull section 106 of the submarine's hull 102 is shown. Depths from 10 to 50 meters below sea level are considered. Typically, the weakest part of the submarine's hull 102 is the middle cylindrical hull section 106, as the other elliptical hull sections 104 and 108 of the submarine's hull 102 are not subject to the same levels of radial and tangential stresses.

The average value of axial stress affecting the body of the submarine (for example, a wall thickness of 3 mm) at a depth of 50 meters (corresponding to an external pressure of 5 bars), was observed to be equal to approximately 13.4 MPa (MegaPascals), while the internal cabin pressure in the submarine was approximately equal to 1 bar.

The maximum value of the tangential stress affecting the submarine's cylindrical middle hull section 106 of the hull 102 can be found at the inner radius, and these values are much larger than those of the radial stresses affecting the submarine.

Referring now to FIG. 6, it can be seen from the graph 600 that as the depth of the submarine increases, the tangential component of stress increases in compression. Comparing the stress to the yield strength (210 MPa) of steel (SAE 1020) used in building the hull of the submarine, it was found that the submarine's hull 102 can handle external pressures of 32 bars (i.e., corresponding to depth of approximately 320 meters).

Ballast System

Referring again to FIG. 1, the cabin 140 of the submarine is pressurized with air all the time during operation in water. This pressurization is necessary for the proper functioning of the diving and floatation system (ballast system), especially during surfacing of the submarine. Due to the design of the ballast system 700, low values of gage pressures are necessary (less than 5 bars). This low pressure is sufficient for the operation of the ballast system even for maximum design operating depths for the submarine 100 under water where pressures are much higher. Cabin pressurization can be provided by either an external air pressure source (e.g., an air compressor or a pressure cylinder), or by operating the submarine compressor (i.e., in the ballast tank system) for a predetermined time prior to the submarine being placed in the water (i.e., when the ballast tank is empty, air is sucked from the atmosphere to the cabin 140 through the ballast tank). This pressurization increases the submarine strength and joint resistance against water leakage into cabin 140.

Figure 7:
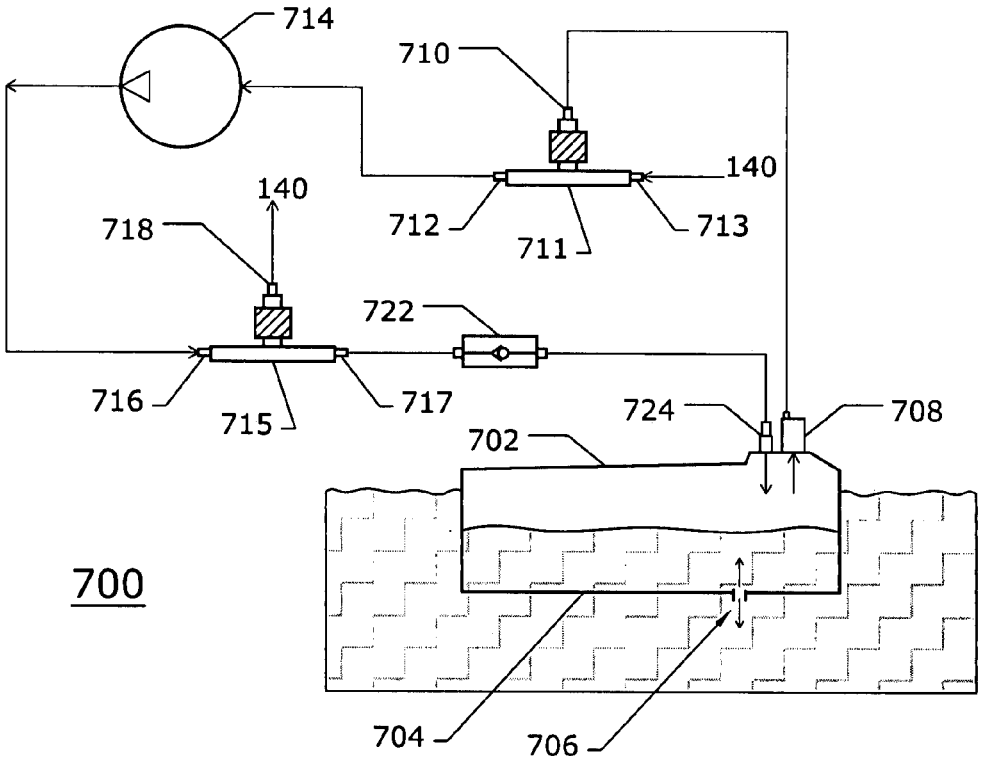
FIG. 7 is a schematic diagram of a pneumatic circuit for effecting the ascend and descend of the submarine of FIG. 1 in a water environment.

Referring to FIG. 7, the diving and floatation (ballast) system 700 includes a ballast tank 702, a reciprocating air compressor 714, a plurality of solenoid valves 711 and 715, at least one check valve 722, and piping for transferring air between the compressor 714 and ballast tank 702. In one embodiment, the ballast tank 702 is cylindrical in shape and is installed on the bottom of the inside wall in the middle cylindrical hull section 106 of the submarine 100. In one embodiment, the tank 702 has a convex cover which causes air inside it to accumulate and go through the air outlet 708. The tank 702 contains several partitions (baffles) which restrict the motion of water to prevent the water in the tank from destabilizing the submarine. The tank has a small opening 706 at its bottom for water to flow into or out of the tank 702.

In one embodiment as shown in FIG. 7, a sealed box, located above the ballast tank 702, contains the reciprocating air compressor 714. The compressor 714 removes air from the enclosed space around it through an opening in the box's wall. The removed air can come from the top of the ballast tank 702 through a one-way valve 708 and a water trap, and pumps it to cabin 140 when the submarine is submersing. The same compressor 714 can be used to pump air from the pressurized cabin 140 back to the ballast tank 702 in order to force water out of the tank during the surfacing operation. The solenoid valves are used to accomplish these two processes. The solenoid valves form part of the pneumatic circuit 700, which control the air flow in a manner which will cause either diving or surfacing of the submarine.

In particular, the submarine 100 is designed to be floating when initially placed in water. Referring to schematic diagram of FIG. 7, the ballast tank 702 is flooded with water through a water opening 706 in the bottom 704 of the tank 702 by sucking air from the tank through the tank's air outlet 708 (water trap). The air from the tank flows through port 710, through port 712, then through the compressor 714, then through port 716, and through port 718 into the cabin 140 of the submarine 100. The air removed from the tank 702 is pressurized and stored in the cabin 140 of the submarine 100 for usage during a reverse operation to force the water out of the tank 702. The removal of air from the tank 702 creates low pressure inside the tank's body 702, which in turn causes water to flow therein, thereby enabling the submarine 100 to gain mass and submerge in the water.

During the surfacing or ascending operations of the submarine 100, the air compressor 714 is operated along with the actuation of the two solenoid valves 711 and 715, such that air is removed from the cabin 140 through port 713, port 712, through the air compressor 714, through port 716, through port 717, through a check valve (non return valve) 722, and then through the tank's air inlet 724 into the tank's body 702. This operation causes air to be pressurized back into the tank 702, thus creating high pressure therein the tank, which in turn causes the discharge of water through the tank's water opening 706 to reduce the mass of the submarine and cause it to ascend and/or float.

In order to provide enough air for the surfacing operation, the interior of the submarine's body (i.e., cabin 140) is pressurized with air before any operation is started. Another advantage of the pressurization with air is that this technique increases the sealing power and the resistance against water leakage into the submarine's cabin 140.

Propulsion System

Referring to FIGS. 8-12, propulsion of the submarine 100 is provided by a propulsion system 800 having least one water pump 802. The system 800 provides forward motion to the submarine by sucking water from a first opening or port 804 in the forward hull section 104, and pumping water from a second opening or port 806 formed in the tail hull section 108 of the submarine. The emerging jet would provide the force needed for the submarine to move.

In one embodiment, a DC-motor-operated water pump 802, located inside the submarine, sucks water from a front opening 804 in the nose 104 of the submarine via a first pipe 810 and ejects it from another opening in the far end of the tail 108 via a second pipe 812.

Stopping the submarine (while in forward motion) and giving it a backward motion is achieved using the same system as in described above but with a reverse water flow. This can be done by several means: (a) connecting another identical pump with the first pump back to back and operating the second pump only for the backward motion; (b) using a flow reversal water circuit with solenoid valves and pipe connections; or (c) having a parallel system to the first one but with a reversed flow direction.

Figure 8:
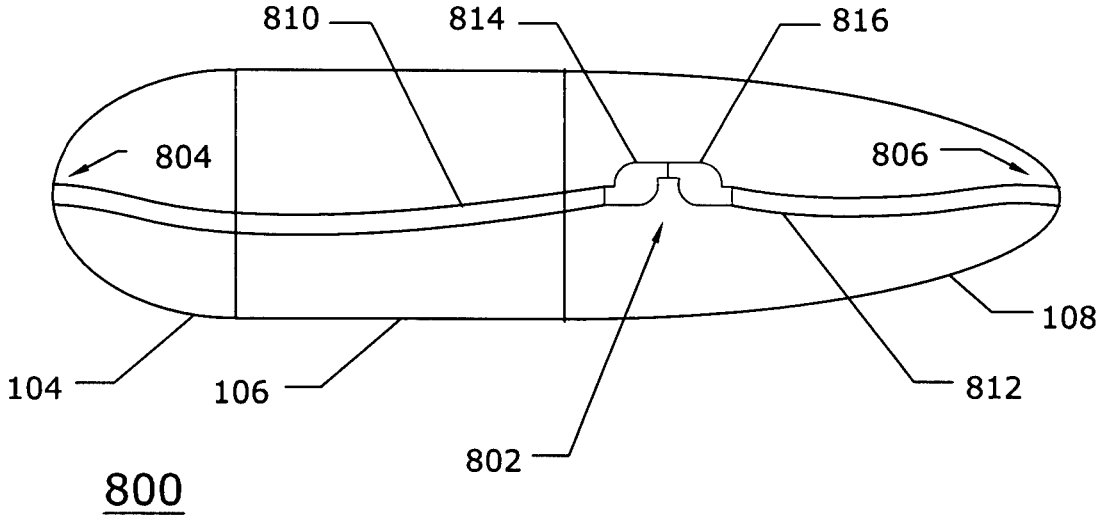
FIG. 8 is a schematic diagram of a first embodiment of a propulsion system of the submarine of FIG. 1.
Figures 9, 10:
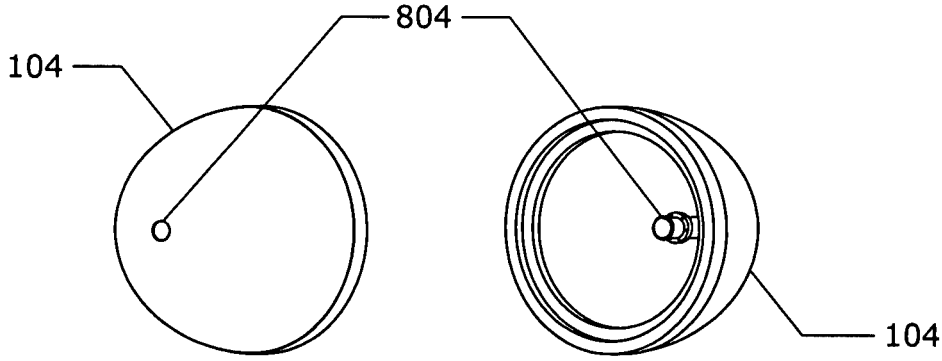
FIG. 9 is an external perspective view of a front port of the propulsion system of FIG. 8 formed in the forward hull section of the submarine of FIG. 1.
FIG. 10 is an internal perspective view of the front port of the propulsion system of FIG. 8, formed in the forward hull section of the submarine of FIG. 1.
Figures 11, 12:
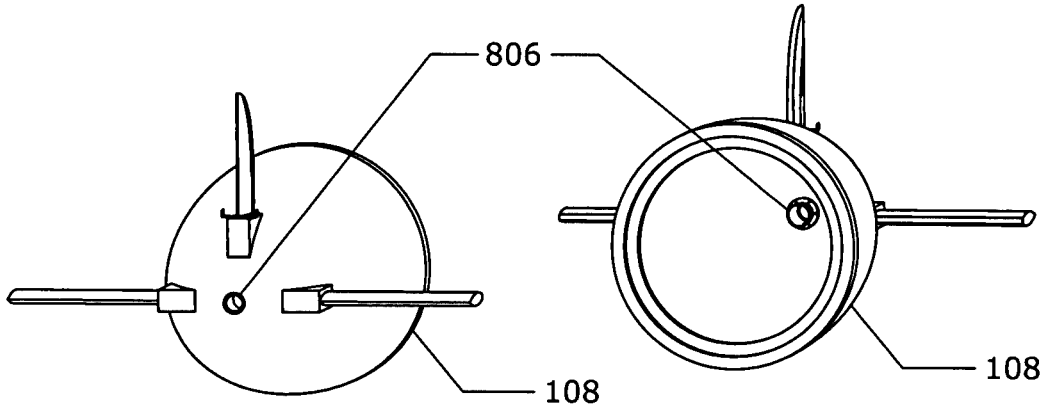
FIG. 11 is an external perspective view of a rear port of the propulsion system of FIG. 8, formed in the aft hull section of the submarine of FIG. 1.
FIG. 12 is an internal perspective view of the rear port of the propulsion system of FIG. 8, formed in the aft hull section of the submarine of FIG. 1.

Referring to the embodiment of FIG. 8, the propulsion system 800 includes two pumps 814 and 816 that are used to provide forward and backward motion of the submarine 100. In order for the submarine 100 to move in the forward direction, the first pump 814 is activated to suck water from the front water opening 804 via pipe 810 and pump the water through the second pump 816 and out of the rear water opening 806 via pipe 812, which provides sufficient thrust for the submarine 100 to move in the forward direction. To propel the submarine in the reverse direction, the second pump 816 is activated to suck water from the rear water opening 806 through the first pump 814 via pipe 812, and out of the front water opening 804 via pipe 810. This reverse operation provides the submarine 100 with sufficient thrust to reduce and stop the forward motion, and then propel the submarine 100 in the reverse direction.

Maneuvering System

Figure 13:
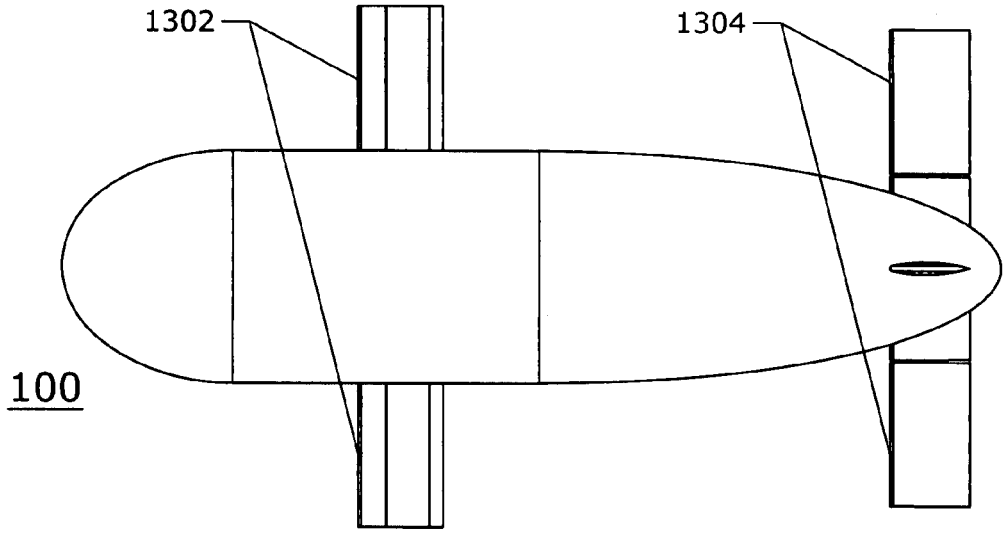
FIG. 13 is a top plan view illustrating the rudder, stabilizers and elevators of a maneuvering system of the submarine of FIG. 1.
Figure 14:
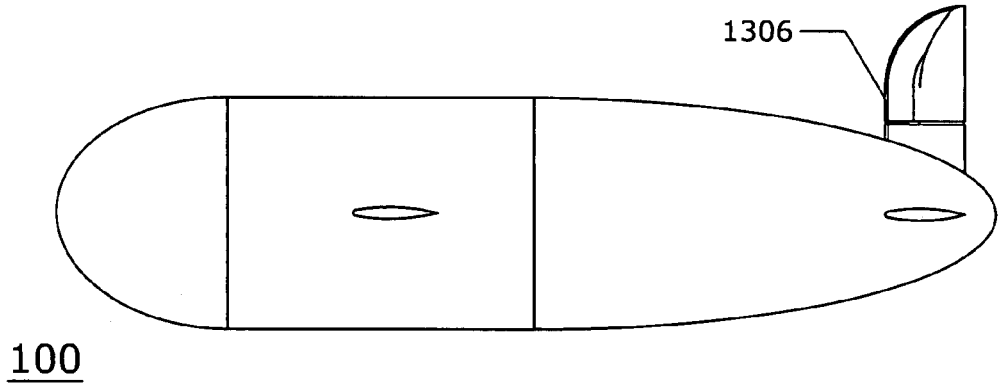
FIG. 14 is a side view of the maneuvering system of the submarine of FIG. 1.
Figure 15:
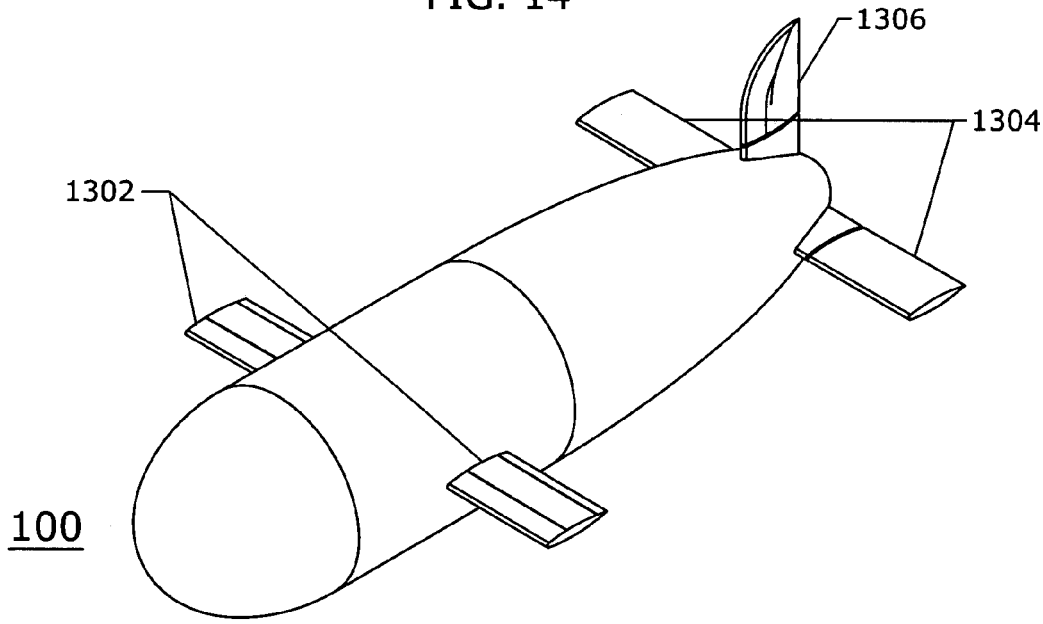
FIG. 15 is a front and top perspective view of the maneuvering system of the submarine of FIG. 1.
Figure 16:
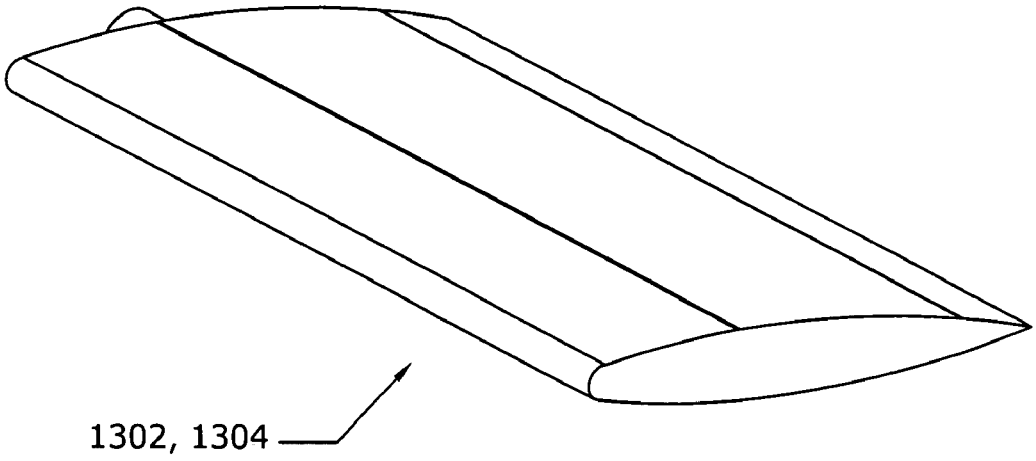
FIG. 16 is a front and top perspective view of one of the side elevators of the maneuvering system of FIGS. 13-15.

Referring to FIGS. 13-15, maneuvering of the submarine 100 is achieved by the use of a plurality of stabilizing fins 1302, elevators 1304, a rudder 1306, and by water jet thrust vectoring, as described below in further detail. A pair of horizontal stabilizing fins 1302 is attached to opposing sides of the middle hull section 106, and act as stabilizers to prevent the submarine 100 against rolling. In one embodiment, the fixed stabilizers 1302 are fixedly welded to the body of the submarine and do not move.

A pair of rear elevator fins 1304 is rotatably attached to opposing sides of the aft hull section 108. The rear elevator fms 1304 assist with maneuvering the submarine and controlling its motion, as well as providing depth stability to the submarine. The rudder 1306 is vertically attached to the aft hull section 108 of the submarine. The rudder 1306 is responsible for steering the submarine 100 in a sideways direction (e.g., left and right). One skilled in the art will appreciate that the forward horizontal pair of stabilizing fins 1302 can also be rotatably attached to the sides of the middle hull section 106 to provide additional maneuverability.

The installation of the rotatable hydrofoil fms 1302, 1304 and rudder 1306 creates three weak points which are susceptible to water leakage. Leakage problems at these points are solved using special sealing units. These seals provide a resilient, watertight opening for enabling the rotational motion of the hydrofoil fins and rudder in addition to preventing water leakage.

Figure 17:
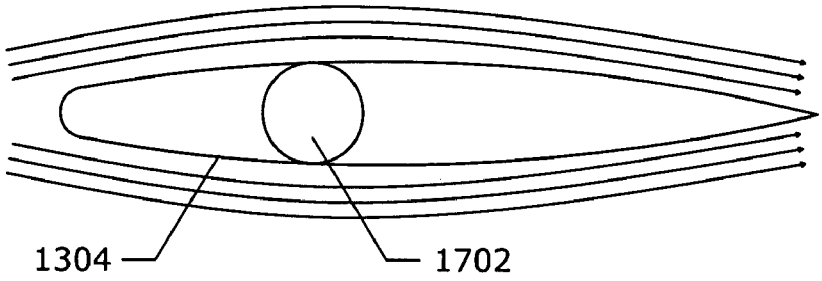
FIG. 17 is a cross-sectional view of the hydrofoil of FIG. 16 illustrating the flow of water about the elevator.
Figure 18A:
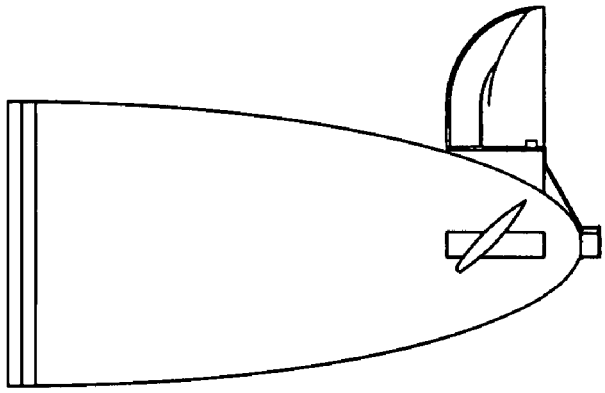
FIGS. 18A-C are respective side views of the aft hull section illustrating various maneuvering positions of the elevators of the submarine of FIG. 1.
Figure 18B:
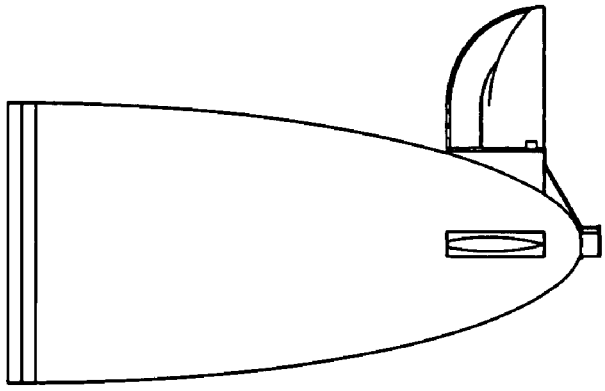
Figure 18C:
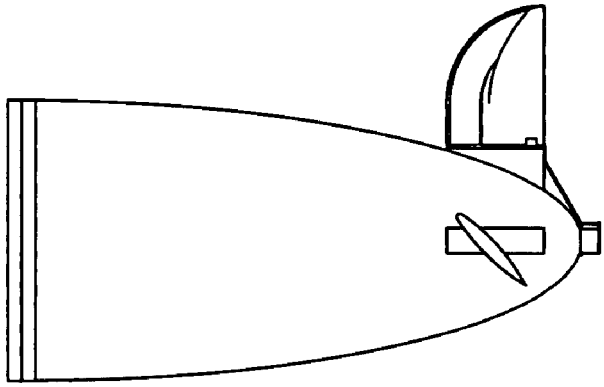

Referring to FIGS. 13-17, the elevators 1304, stabilizing fins 1302, and rudder 1306 are formed, for example, by symmetric hydrofoil sections in order to reduce drag and enable the submarine to ascend (float) and submerge (dive) in the water environment during operation. Referring to FIG. 17, a circular shaft 1702 is provided at one end of the hydrofoil for attachment to a motorized gear box (not shown) for rotating the hydrofoil, as required.

In one embodiment, the elevators 1304 and rudder 1306 are actuated by two DC motors; one for the elevators and the other for the rudder. In order to rotate the rudder 1306, the motor is linked to the rudder via a friction disk. The disk is attached to a small shaft that is fixed to the rudder itself. The elevators are actuated by the second DC motor. In order to actuate both elevators at the same time, a power screw is linked to the motor. A nut near the other end of the power screw is then attached to a link which connects the elevators 1304. Preferably, the elevators 1304 can move between −45 and +45 degrees as illustratively shown in FIGS. 18A-C, although such range of movement is not considered limiting.

Figure 19:
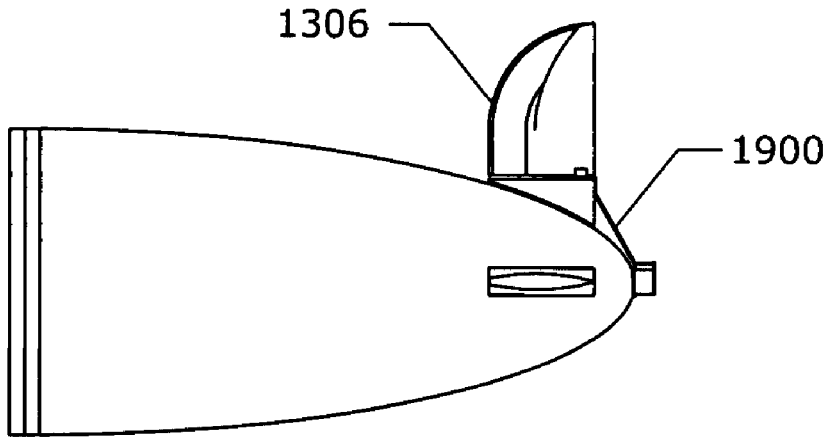
FIG. 19 is a side view of the aft hull section having a thrust vector system for steering the submarine of FIG. 1.
Figure 20:
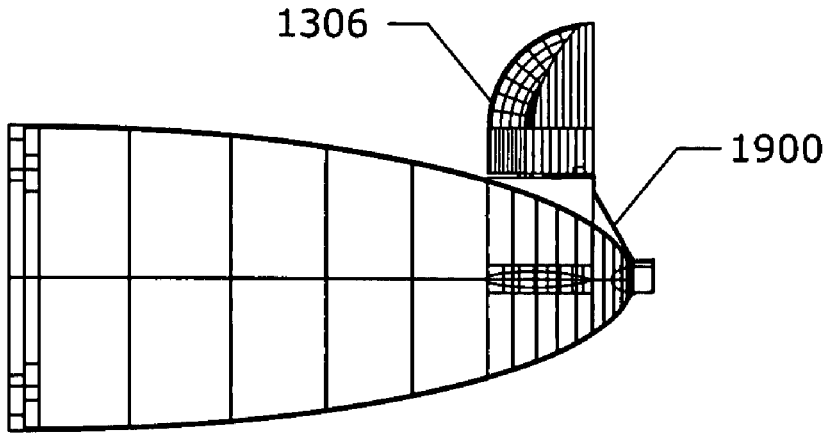
FIG. 20 is a cross-sectional view of the aft hull section and thrust vector system of FIG. 19.

Referring to FIGS. 19 and 20, in one embodiment, a thrust vectoring mechanism 1900 is installed proximate the second port 806 of the propulsion system which is provided at the rear hull section 108. The thrust vectoring mechanism 1900 is provided to operate along with the rudder 1306 to assist with steering of the submarine 100.

Figure 21:
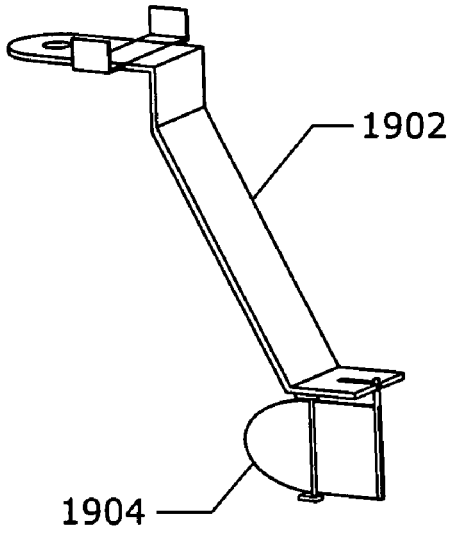
FIG. 21 is a top side perspective view of the thrust vector system of FIGS. 19 and 20.
Figure 22:
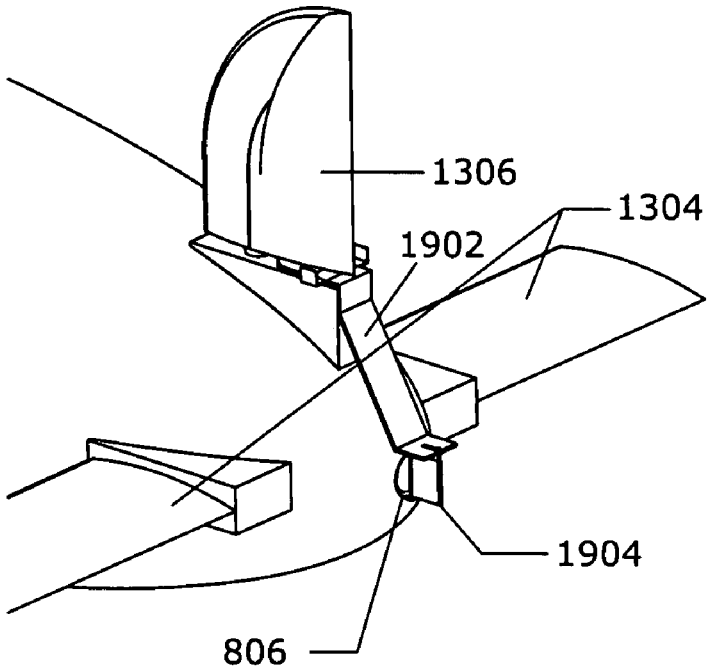
FIG. 22 is a rear and top perspective view of the aft hull section and thrust vector system of FIG. 19.

Referring to FIGS. 21 and 22, the thrust vectoring mechanism 1900 includes a link member 1902 that moves a vertical circular plate 1904, which is installed inside the rear port 806 of the propulsion system. The link 1902 is moved and actuated by the rudder 1306 with minimal motion delay. The small plate 1904 controls the angle at which the water jet leaves the rear port 806 of the submarine 100, which causes the submarine 100 to change its direction of motion.

Figure 23:
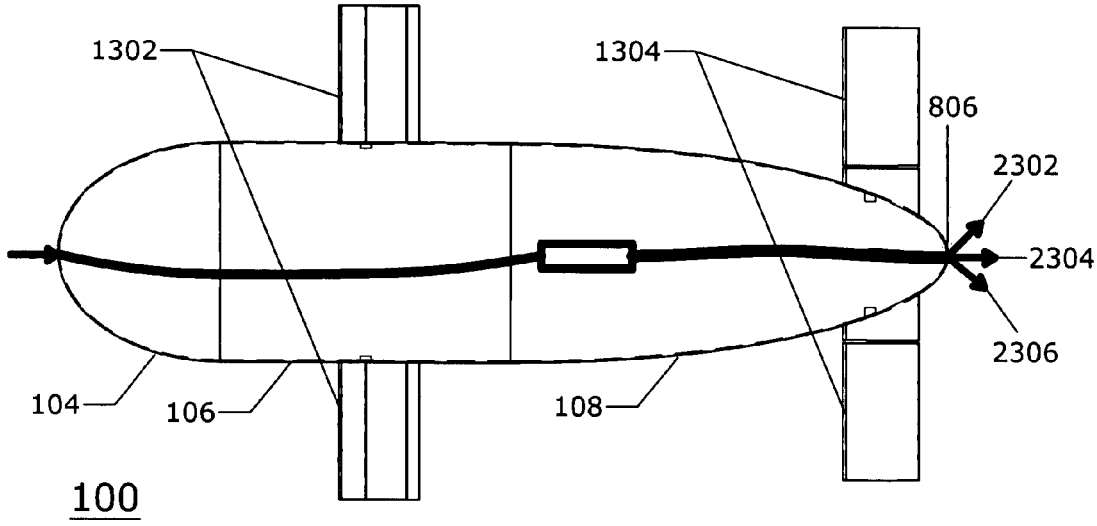
FIG. 23 is a schematic diagram illustrating maneuvering the submarine of FIG. 1 using the propulsion system and thrust vector system of FIGS. 8-12 and 19-22, respectively.

Referring to FIG. 23, there are three possible directions for the water jet to leave the rear port 806 of the submarine 100. If the water jet exits the rear port 806 along direction 2302, then the submarine is propelled to the right. If the water jet exits the rear port 806 along direction 2304, then the submarine is propelled in a straightforward path. Alternatively, if the water jet exits the rear port 806 along direction 2306, then the submarine is propelled to the left.

Figure 24:
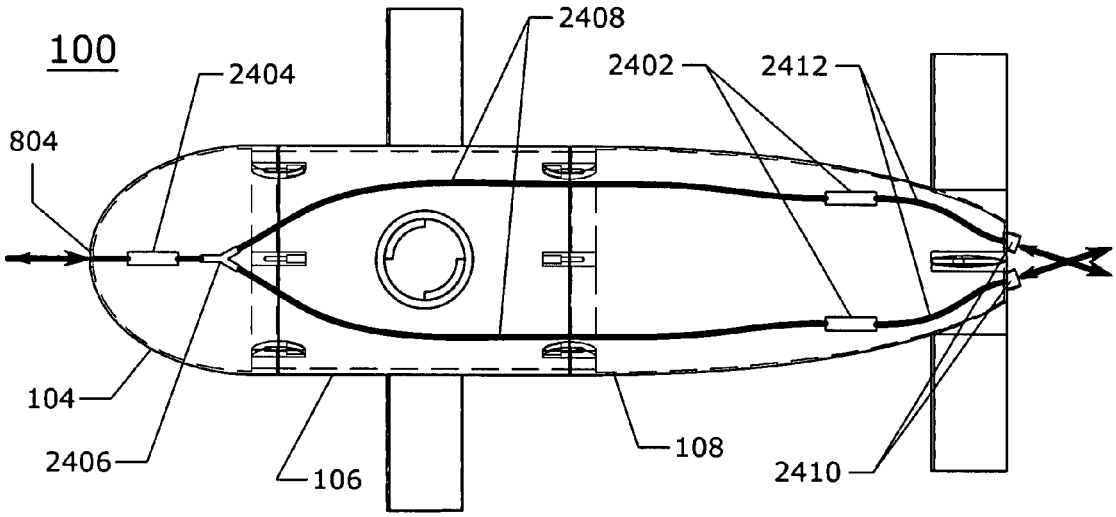
FIG. 24 is a schematic diagram of an alternative embodiment of a propulsion system suitable for use in the submarine of FIG. 1.

FIG. 24 illustrates another embodiment for supporting (or replacing) the rudder 1306 in steering the submarine 100. In particular, two parallel pumps 2402 are provided, illustratively in the rear hull 108 to propel and steer the submarine 100, instead of using only one pump as described above with respect to the embodiment of FIGS. 8-12 and 23. A third forward pump 2404 is located in the forward hull section 104. The third forward pump 2404 is activated when stopping the submarine or backward motion is desired.

In particular, the forward pump 2404 is connected between the front opening 804 formed in the forward hull section 104 and a Y-connection 2406 that is coupled to a pair of main pipes 2408, which transfer water from the front opening 804 to the rear parallel pumps 2404. Each of the pair of pumps 2404 is coupled by a conduit 2412 to a corresponding rear port 2410 formed at the aft hull section 108.

As shown in FIG. 24, water enters the submarine 100 from the front opening 804 and into the Y-connection 2406 which splits the flow into two parts delivered to two parallel pumps 2402. The parallel pumps 2402 operate to force water out of the submarine through two rear ports 2410 to propel the submarine in a forward straight direction. Steering of the submarine can be effected by operating one of the parallel pumps 2402 while shutting down the other, which causes the water jet from the corresponding rear port 2410 to change the direction of the submarine 100. One advantage of the parallel pump propulsion system 2400 of FIG. 24 is that the thrust vectoring mechanism 1900 is not required, thereby eliminating any possible damage to the links 1902 and 1904 caused by unknown objects (e.g., rocks), which might occur while moving underwater.

In an alternative embodiment, the submarine steering system includes two openings in the tail of the submarine separated by an appropriate distance and on both sides of the first central opening. The two emerging water jets are not parallel but they meet at a point downstream from the tail end of the submarine. Allowing more water to flow in one of these side openings than the other will cause the submarine to turn right or left as desired. One or two water pumps can be used for this configuration.

In the one-pump system, the output of the pump is branched into two pipes to the two openings in the back of the submarine. The flow rate of water in each branch can be controlled via throttling valves. Alternatively, in the two-pump system, two identical water-jet pump systems are installed parallel to each other. The nose of the submarine can have either a common opening or two openings. The flow rate in each branch can be controlled by the voltage supplied to each pump, or alternatively by throttling one branch for a short time to cause a turning moment on the submarine.

Control and Power Systems

Figure 26:
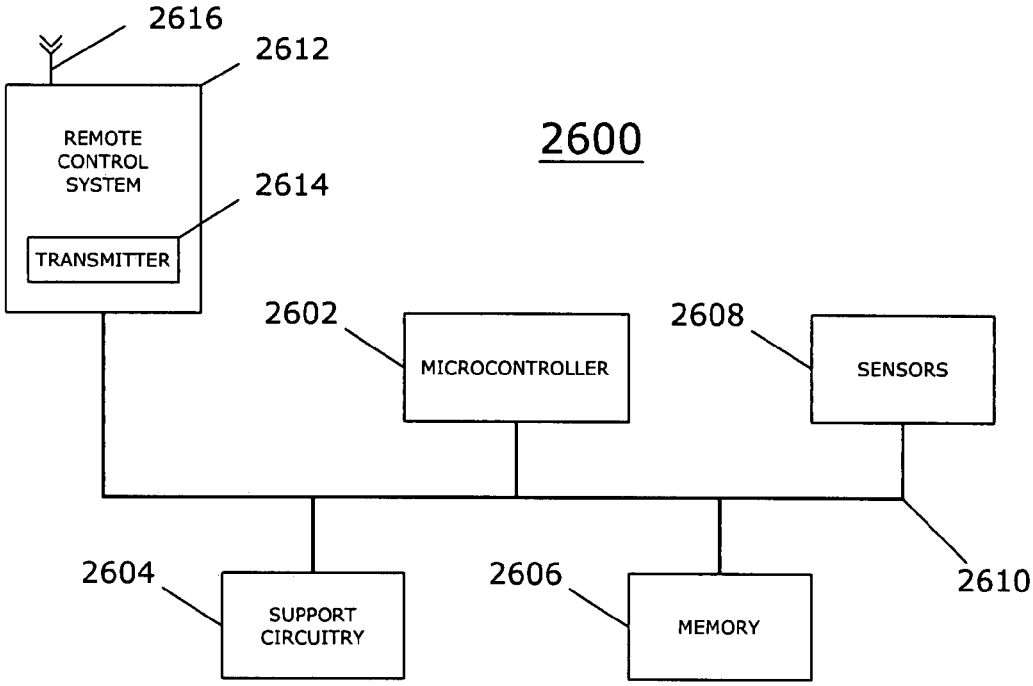
FIG. 26 is a schematic diagram of a controller and sensor array for controlling the unmanned autonomous submarine of FIG. 1.

Referring to FIG. 26, an illustrative controller 2600 is provided to control the submarine 100 such that it is completely autonomous. The controller 2600 includes a microprocessor 2602, support circuitry 2604, memory 2606 a plurality of sensors 2608 and one or more bus lines (conductors) for providing electrical signals therebetween. In one embodiment, a (Motorola 68HC11A8) microcontroller is chosen to serve as the main control unit of the submarine. The microcontroller utilizes programs and routines stored in memory 2606 to control the submarine and translate the electrical signals from the various sensors 1608 into electrical signals delivered to the various actuators of the submarine's systems.

The microcontroller 2602 can be programmed with special programs that enable the submarine 100 to perform various special tasks. The programs can set certain trajectories for the submarine to follow during its motion. For example, the microcontroller 2602 can be programmed to guide the submarine 100 around a docked ship and inspect the submerged part of its hull. The microcontroller 2602 can also be programmed to direct the submarine 100 to cruise while submerged in the water to search for one or more objects and then surface after finding the object. During its operation, the sensors 2608 enable the submarine to detect obstacles and decide for itself whether to stop, pull back or change its direction of motion to avoid collision.

The support circuitry 2604 can include power supplies, logic circuitry, cache, I/O circuitry, among other conventional support circuits. The memory 2606 can be cache memory, RAM, ROM, programmable memory, and can be apart from and/or integrated with the microcontroller 2602.

The plurality of sensors 2608 are used to sense the environment and the physical properties surrounding the submarine 100, such as the surrounding water pressure, and to convert these quantities into electrical signals that can be used by the control media of the submarine 100 to decide a sequence of operation according to the inputs.

The sensors 2608 that can be used and installed in the submarine can include SONAR sensors, used for obstacle detection and for scanning the seabed; a pressure transducer, used for depth measurement; speed measurement sensors; as well as a GPS system, to keep track of the submarine's location; an attitude sensor which keeps track of the direction of motion.

In addition, a video camera and audio equipment can be attached to the submarine 100 to transmit images and sounds to the operator at the surface. The video camera can further be used for control purposes by linking it to the controller 2600 of the submarine, and using some image processing principles.

Further, the submarine can be programmed to perform more specialized tasks by installing additional special links and equipment, such as a manipulator (robotic) arm, which can be used for gathering samples for research and for retrieval of sunken objects; laser sensors for detecting faults and cracks in underwater structures like dams, bases of oil rigs, and underwater pipes and cables; special equipment for detecting faults in submerged parts of ship hulls at seaports; underwater welding equipment, among other specialized devices and equipment suitable for underwater operations.

In order to increase the reliability of the submarine, a remote control (RC) system 2612 is installed in the submarine 100. The remote control system 2612 includes at least a receiver, and preferably a transmitter and receiver (transceiver) 2614 that enables the operator to override one or more programs of the controller 2260 to take full control of the submarine, for example, in the case of emergency situations.

The receiver 2614 of the RC system 2612 is installed inside the submarine 100 with an insulated antenna 2616 sticking out of the hull 102. Furthermore, the antenna 2616 can be linked to a floating antenna by a reeling wire in order to guarantee that the signal transmission can not be interrupted as the submarine dives deeper and deeper due to the dispersion of electromagnetic waves in water.

Source of Power:

In one embodiment, the submarine includes a plurality of batteries as the main power source of the submarine. In one embodiment, the batteries include a set of several 12-Volt sealed lead acid rechargeable batteries. These batteries can provide enough power for the systems of the submarine for reasonably long missions. If more power is needed for lengthy missions, special Lithium batteries can be used which can provide more power for such missions.

Figure 25:
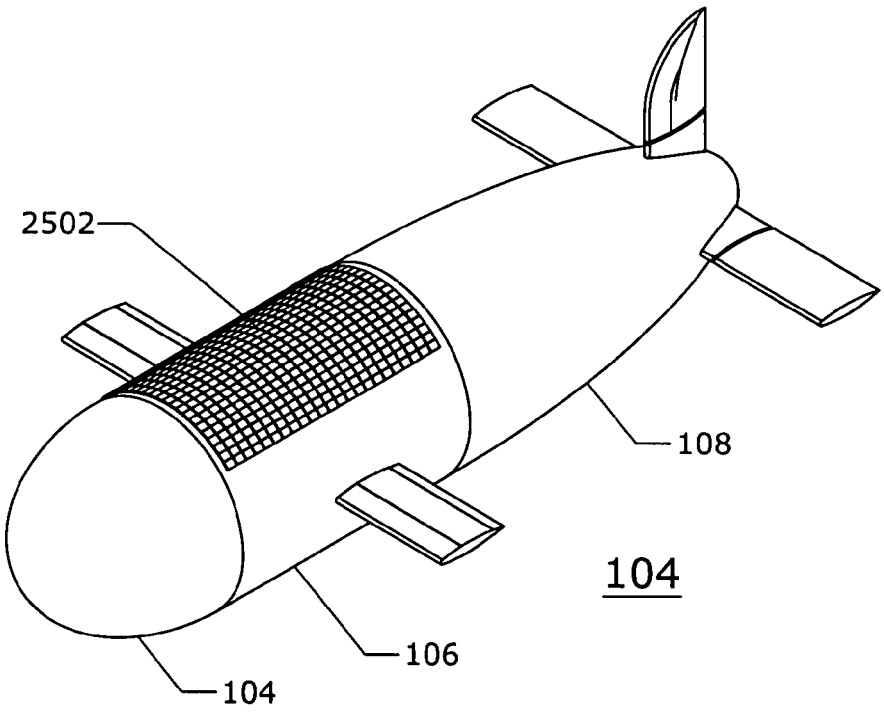
FIG. 25 is a front top perspective view of the unmanned autonomous submarine of FIG. 1 having a plurality of photovoltaic cells installed on the exterior surface of the hull.

Referring to FIG. 25, in one embodiment, photovoltaic cells 2502 are provided to recharge the batteries during the floating period of the submarine 100, and thus make the submarine more independent for long missions. The photovoltaic cells 2502 are used in a sealed panel that cover the top surface of middle hull section 106 of the submarine. Additional photovoltaic cells 2502 can be installed on the forward and aft hull sections 104 and 106 as well. The photovoltaic cells 2502 can charge the batteries or run the various power components in the submarine during daytime when the sun is shining even when it is diving at shallow depths.

It will be apparent to those skilled in the art that various modifications and variations can be made to the present invention without departing from the spirit and scope of the invention. Thus, it is intended that the present invention cover the modifications and variations of this invention that come within the scope of the appended claims and their equivalents.

What is claimed is:

1. An unmanned autonomous submarine, comprising:

a hull formed by at least two hull sections and defining an interior cabin therein, said cabin adapted to retain pressurized air;

a plurality of fasteners affixed to said hull sections and adapted for joining said at least two hull sections, said plurality of fasteners being one of internally and externally affixed to opposing connecting ends of said hull sections;

a plurality of hydrofoils attached to opposed external side surfaces of said hull sections for providing stability and maneuverability of said hull;

a propulsion system for providing propelling force to said hull; and a ballast system for raising and submersing said hull, said ballast system comprising:

a ballast tank adapted to receive a predetermined level of water externally from the submarine and a predetermined amount of the pressurized air from said cabin; and a compressor coupled to said ballast tank to form a closed loop system, said compressor adapted to force air into said cabin from said ballast tank to increase the water level in the tank and thereby cause said hull to submerge, and said compressor being adapted to force air into said ballast tank from said cabin to decrease the water level in the tank and thereby cause the submarine to ascend.

2. The submarine of claim 1, further comprising a sealable opening formed in the upper portion of one of said hull sections for providing access into said interior cabin.

3. The submarine of claim 1, wherein said plurality of fasteners include a plurality of clamps.

4. The submarine of claim 1, wherein said plurality of fasteners include a plurality of bolts positioned on one of said connecting ends of a hull section and threaded into a corresponding plurality of nuts affixed to an opposing connecting end of an adjacent hull section.

5. The submarine of claim 1, further comprising an o-ring inserted between each adjacent hull section.

6. The submarine of claim 1, further comprising a reinforcing ring inserted between each adjacent hull section.

7. The submarine of claim 1, wherein said ballast tank comprises a plurality of partitions to prevent water in the tank from destabilizing the submarine.

8. The submarine of claim 1, wherein said ballast tank comprises a sealable opening formed at its bottom for controlling flow of water in or out of the tank.

9. The submarine of claim 1, wherein said ballast system further includes at least one solenoid valve for controlling air flow between said cabin and said ballast tank.

10. The submarine of claim 1, wherein said propulsion system includes:

a first water pump positioned in said cabin;

a forward inlet port formed in a forward hull section of said hull sections and coupled to said pump via a first conduit; and an aft outlet port formed in an aft hull section of said hull sections and coupled to an output of said first pump via an aft conduit; wherein said first pump draws water external to said hull through said forward inlet port and first conduit, and forces said water through said aft outlet port to propel said submarine in a forward direction.

11. The submarine of claim 10, further comprising a second aft outlet port formed in the aft hull section and coupled to said first pump via a second aft conduit, wherein said aft conduits are regulated to control water flow therethrough to provide steering of said submarine.

12. The submarine of claim 10, wherein said first water pump draws water external of said hull through said aft outlet port and said aft conduit, and forces the water through said forward inlet port to propel said submarine in a reverse direction.

13. The submarine of claim 12, further comprising a second water pump serially coupled to said first water pump, said second water pump being deactivated while said first pump is activated to propel said submarine in the forward direction.

14. The submarine of claim 13, wherein said first pump is deactivated while said second pump is activated to draw water external to said hull through said aft outlet port and aft conduit, and force said water out of said forward inlet port to propel said submarine in a reverse direction.

15. The submarine of claim 10, further comprising a plate pivotably attached in a vertical direction in said aft outlet port, said vertically positioned plate being rotatable to direct the water jetted out of said aft outlet port at a predetermined angle to steer said submarine.

16. The submarine of claim 15, further comprising:

a vertical rudder rotatable attached to said aft hull section; and a link coupled between said rudder and vertical plate, wherein rotation of said plate is controlled by rotation of said rudder.

17. The submarine of claim 1, wherein said propulsion system includes:

a forward water pump positioned in said cabin;

a forward inlet port formed in a forward hull section of said hull sections and coupled to said forward pump via a forward conduit;

a pair of parallel water pumps positioned in said cabin, said parallel pumps coupled to said forward water pump via a Y-shaped conduit; and a pair of aft outlet ports formed in an aft hull section of said hull sections, each aft outlet port being coupled to a corresponding one of said parallel water pumps via a second conduit; wherein at least one of said parallel water pumps draws water external to said hull through said forward inlet port and forward conduit, and forces said water out of said corresponding aft outlet port to propel said submarine in a substantially forward direction.

18. The submarine of claim 17, wherein said forward water pump is deactivated when said pair of parallel water pumps is activated to propel said submarine in a substantially forward direction.

19. The submarine of claim 17, wherein said pair of parallel pumps is deactivated while said forward pump is activated to draw water external to said hull through said aft outlet ports and Y-shaped conduit, and force said water out of said forward inlet port to propel said submarine in a reverse direction.

20. The submarine of claim 17, wherein one of said parallel pumps is one of throttled back and deactivated while the other is activated to steer said submarine in a predetermined direction.

21. The submarine of claim 1, further comprising a vertical rudder rotatably attached to an aft hull section of said hull sections for steering said submarine.

22. The submarine of claim 1, wherein said plurality of hydrofoils comprises:

a pair of aft hydrofoils rotatably attached to opposing side surfaces of an aft hull section of said hull sections, said rotatably attached hydrofoils enabling said submarine to submerge and ascend.

23. The submarine of claim 1, wherein said plurality of hydrofoils comprises a pair of forward hydrofoils fixedly attached to said opposing side surfaces proximate a forward hull section of said hull sections, said fixedly attached hydrofoils providing stability for said submarine.

24. The submarine of claim 1, wherein said plurality of hydrofoils comprises a pair of forward hydrofoils rotatably attached to said opposing side surfaces proximate a forward hull section of said hull sections, said rotatably attached hydrofoils enabling said submarine to submerge and ascend.

25. The submarine of claim 1 wherein said hull sections comprises a forward hull section, an aft hull section, and a middle hull section attached therebetween said forward and aft hull sections via said plurality of fasteners.

26. The submarine of claim 1, wherein said propulsion system includes:

a pair of forward inlet ports formed in a forward hull section of said hull sections;

a pair of parallel water pumps positioned in said cabin, each parallel pump coupled to a corresponding one of said pair of forward inlet ports via a forward conduit; and a pair of aft outlet ports formed in an aft hull section of said hull sections, each aft outlet port being coupled to a corresponding output of one of said parallel water pumps via an aft conduit; wherein at least one of said parallel water pumps draws water external of said hull through said corresponding forward inlet port and forward conduit, and forces said water out of said corresponding aft outlet port to propel and steer said submarine in a substantially forward direction.

27. The submarine of claim 26, wherein at least one of said parallel water pumps draws water external to said hull through said corresponding aft outlet port and aft conduit, and forces said water out of said corresponding forward inlet port to propel and steer said submarine in a substantially reverse direction.

28. The submarine of claim 1, further comprising a programmable controller for controlling operations of said submarine.

29. The submarine of claim 1, further comprising one or more sensors for providing electrical signals to said controller for further controlling said submarine operations.

30. The submarine of claim 29, wherein said one or more sensors is selected from the group of sensors comprising depth sensors, GPS system sensors, pressure sensors, position and orientation sensors, speed sensors, leakage sensors, audio sensors and video sensors.

31. The submarine of claim 29, further comprising at least one robotic arm mounted to said hull and electrically coupled to said controller.

32. The submarine of claim 1, further comprising at least one battery for providing power to said submarine.

33. The submarine of claim 32, wherein said at least one battery is rechargeable.

34. The submarine of claim 33, further comprising an array of photovoltaic cells mounted to the exterior surface of said hull.

35. The submarine of claim 34, wherein said array of photovoltaic cells provide charge to said rechargeable batteries.

36. The submarine of claim 34, wherein said array of photovoltaic cells provide power to said submarine.

37. The submarine of claim 28, further comprising a receiver for receiving remote command signals to control operations of said submarine.

38. The submarine of claim 28, further comprising a transmitter for sending operational information to a remotely located receiver.

39. An unmanned autonomous submarine, comprising:

a hull formed by at least two hull sections and defining an interior cabin therein, said cabin adapted to retain pressurized air;

a plurality of fasteners affixed to said hull sections and adapted for joining said at least two hull sections, said plurality of fasteners being one of internally and externally affixed to opposing connecting ends of said hull sections;

a plurality of hydrofoils attached to opposed external side surfaces of said hull sections for providing stability and maneuverability of said hull;

a propulsion system for providing propelling force to said hull, said propulsion system comprises;

a first water pump positioned in said cabin;

a forward inlet port formed in a forward hull section of said hull sections and coupled to said pump via a first conduit;

an aft outlet port formed in an aft hull section of said hull sections and coupled to an output of said first pump via an aft conduit; wherein said first pump draws water external to said hull through said forward inlet port and first conduit, and forces said water through said aft outlet port to propel said submarine in a forward direction; a ballast system for raising and submersing said hull, said ballast system comprising:

a ballast tank adapted to receive a predetermined level of water externally from the submarine and a predetermined amount of the pressurized air from said cabin;

a compressor coupled to said ballast tank to form a closed loop system, said compressor adapted to force air into said cabin from said ballast tank to increase the water level in the tank and thereby cause said hull to submerge, and said compressor being adapted to force air into said ballast tank from said cabin to decrease the water level in the tank and thereby cause the submarine to ascend;

a programmable controller for controlling operations of said submarine; and one or more sensors for providing electrical signals to said controller for further controlling said submarine operations.

* * * * *